US006824224B1

(12) United States Patent
Guadagno

(10) Patent No.: US 6,824,224 B1
(45) Date of Patent: Nov. 30, 2004

(54) COALBED METHANE EXTRACTION PROCESS

(75) Inventor: J. Richard Guadagno, Paonia, CO (US)

(73) Assignee: Cimarron Technology, Ltd., Paonia, CO (US)

( * ) Notice: Subject to any disclaimer, the term of this patent is extended or adjusted under 35 U.S.C. 154(b) by 0 days.

(21) Appl. No.: 10/600,522

(22) Filed: Jun. 19, 2003

Related U.S. Application Data

(60) Provisional application No. 60/389,775, filed on Jun. 19, 2002.

(51) Int. Cl.[7] ..... E21C 41/18
(52) U.S. Cl. ..... 299/2; 299/8
(58) Field of Search ..... 299/2, 7, 8, 10, 299/18, 12; 166/265, 105.5, 369, 370

(56) References Cited

U.S. PATENT DOCUMENTS 4,245,699 A * 1/1981 Steeman ..... 299/2
4,265,737 A * 5/1981 Smith et al. ..... 299/8
4,303,274 A * 12/1981 Thakur ..... 299/2
4,452,489 A * 6/1984 Richards ..... 299/2
6,554,368 B2 * 4/2003 Drake et al. ..... 299/8
6,591,903 B2 * 7/2003 Ingle et al. ..... 166/369

* cited by examiner

*Primary Examiner*—John Kreck

(57) ABSTRACT

A method and system for recovering coalbed methane are disclosed. The method involves tunneling along a seam of coal to a point below a water table and at a depth below the water table sufficient for dissolved methane to be present in the water; separating a portion of the water containing dissolved methane while below the water table; reducing pressure on the separated portion for extracting dissolved methane; removing the extracted methane; and discharging the separated portion of water after extracting dissolved methane.

30 Claims, 5 Drawing Sheets

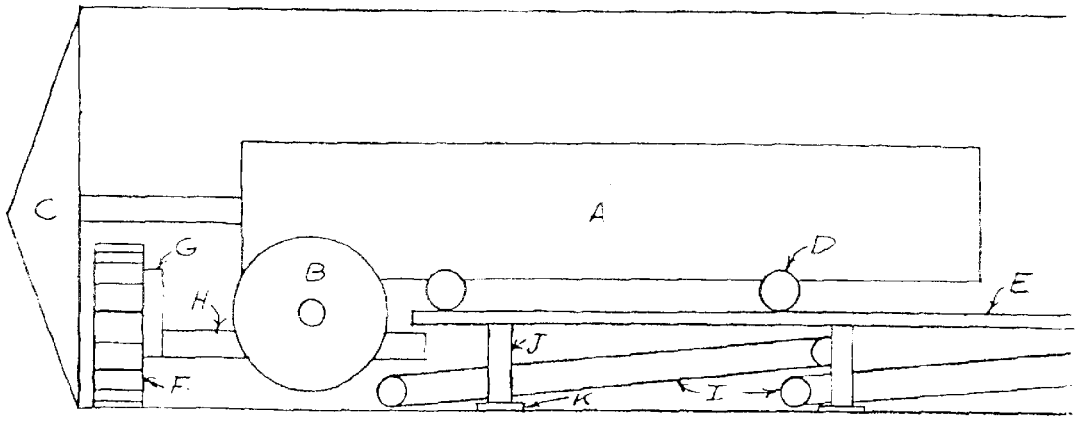
FIG. 1 Boring Machine and Related Components

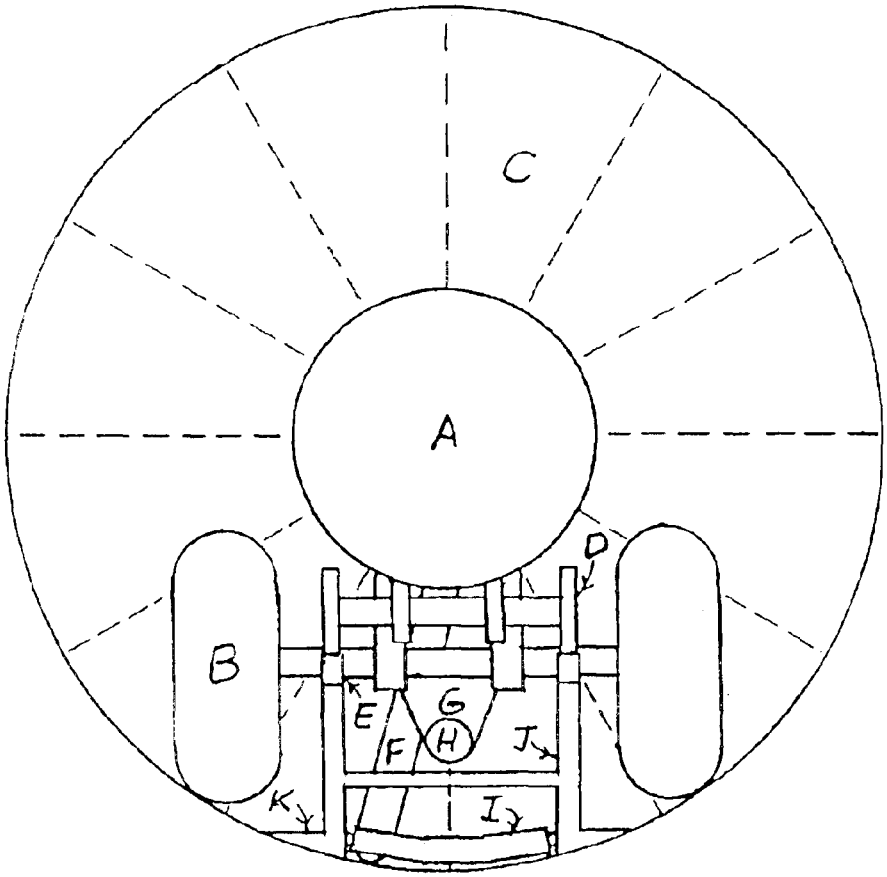
FIG. 2. Rear View of Boring Machine and Related Equipment

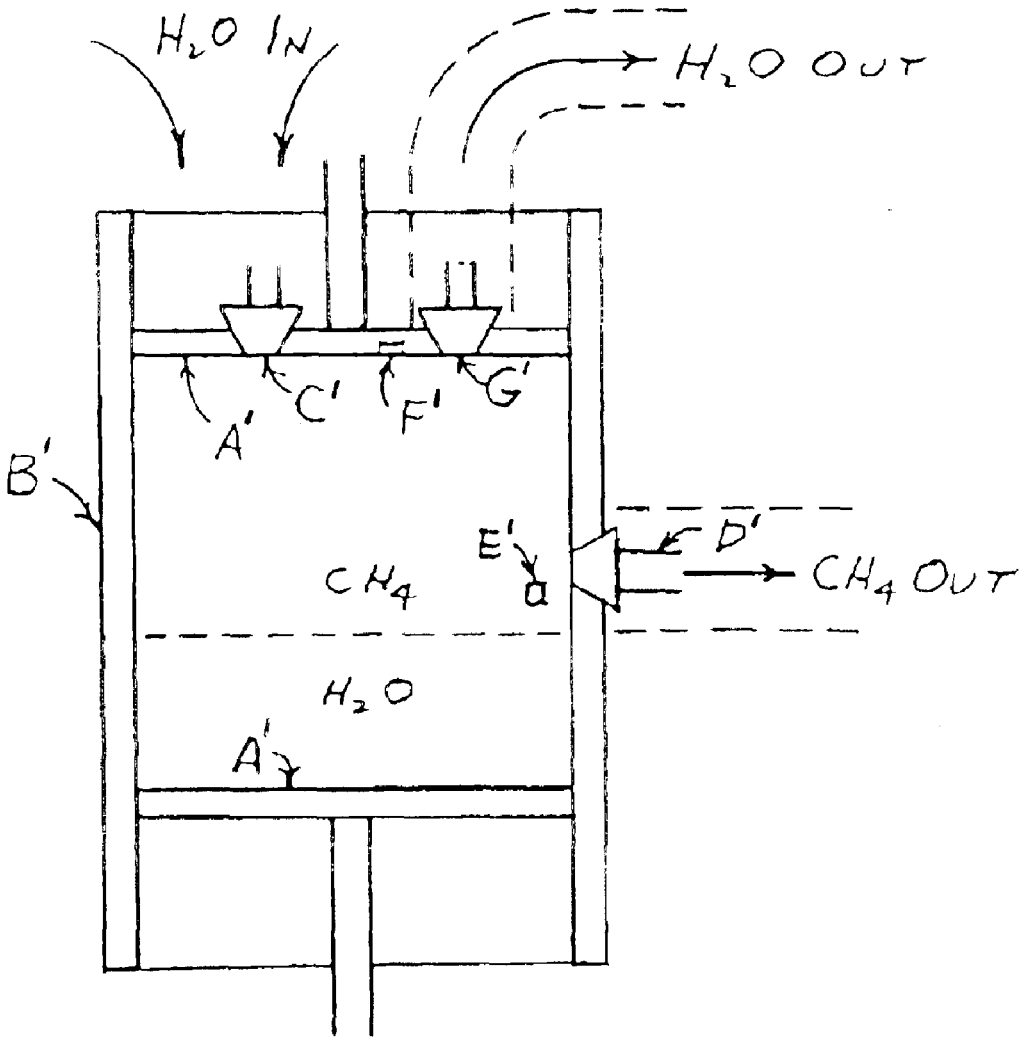
FIG. 3 Methane Separator

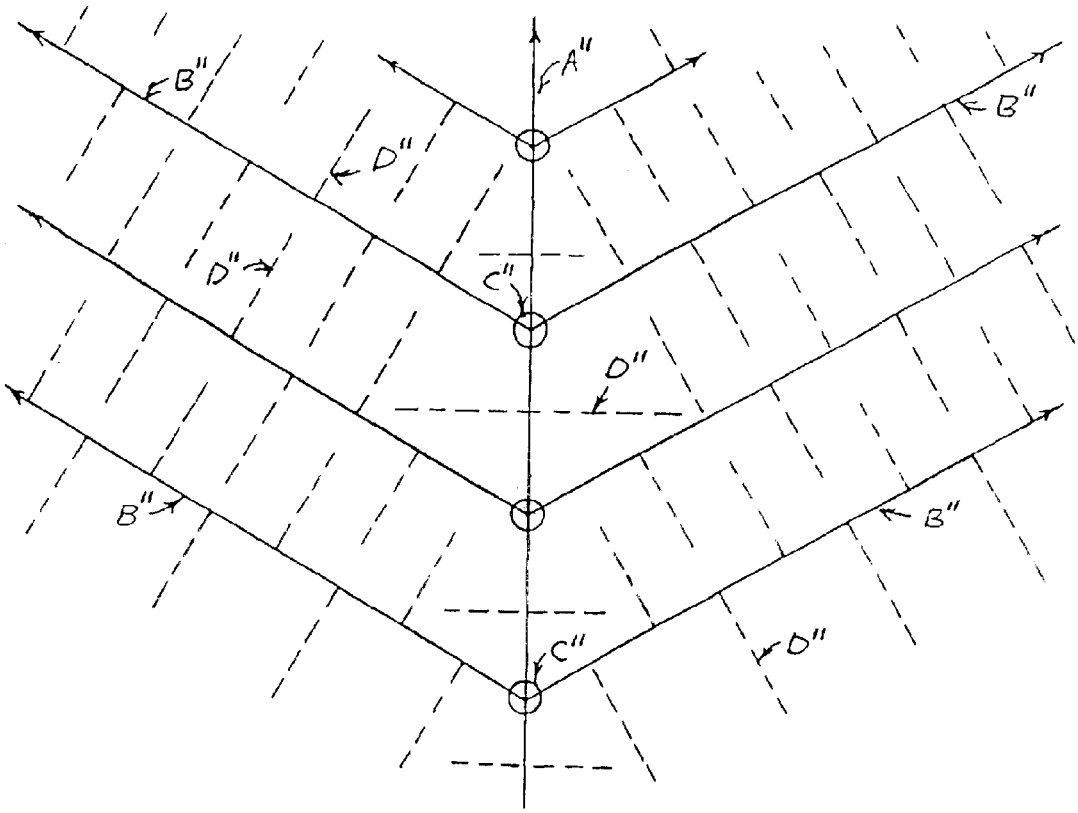
FIG. 4 Typical Tunnel Layout

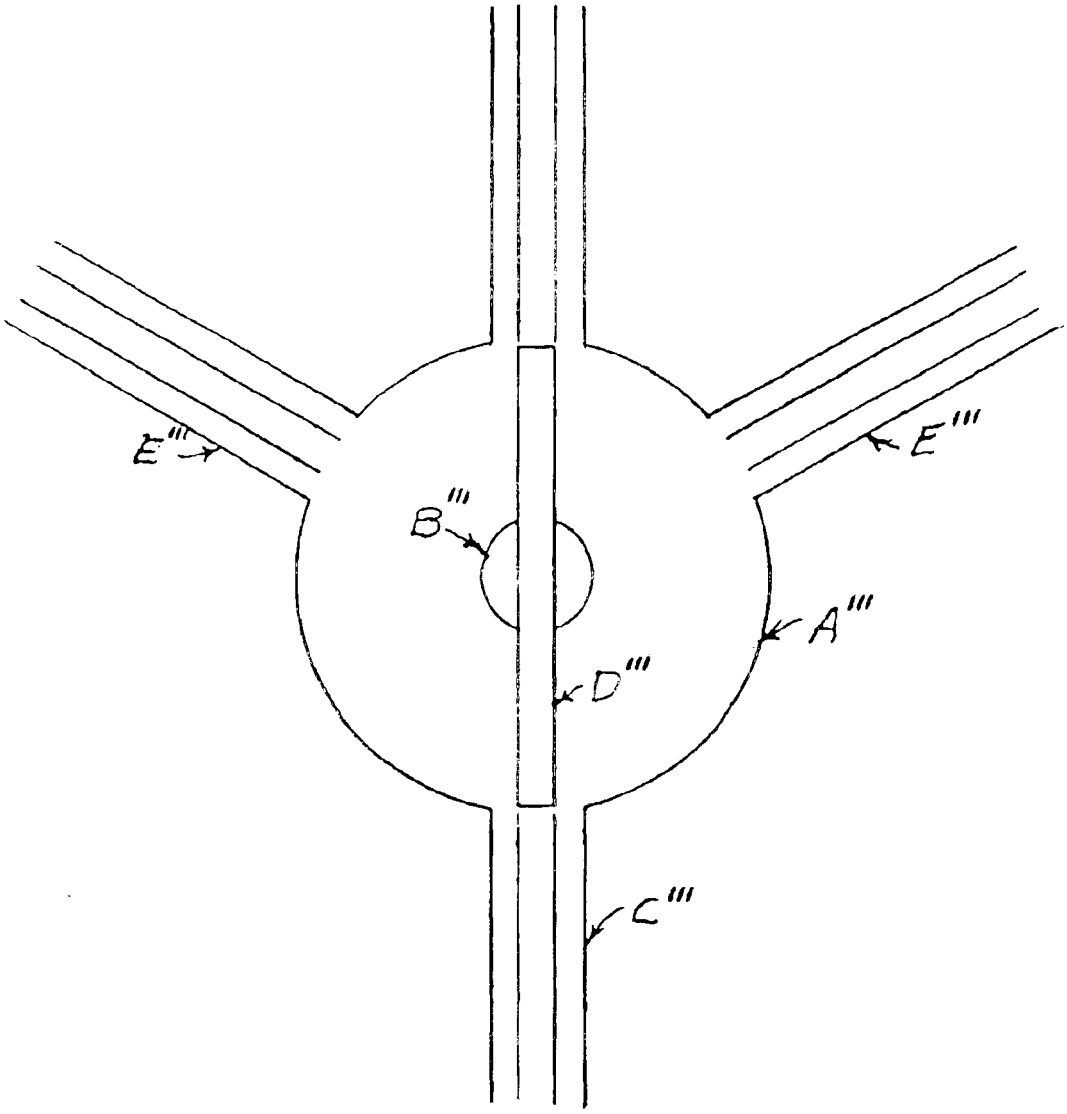
FIG. 5 Tunnel Junction Layout

COALBED METHANE EXTRACTION PROCESS

CROSS-REFERENCE TO RELATED APPLICATION(S)

This application claims the benefit of U.S. Provisional Application No. 60/389,775, filed on Jun. 19, 2002.

BACKGROUND

This invention relates to a method of extracting methane dissolved in water which saturates certain coal beds. More particularly, it relates to a method which may not require the drilling of wells, the upgrading of existing roads, the construction of new roads on currently undisturbed lands, or the construction of a network of new pipelines across public and/or private lands. It may proceed without generating offensive noise or raising dust clouds. It may not cause disturbance to surface lands or require their restoration. It may not bring about a decrease in local property values. It may not lead to increased erosion or sedimentation in the areas where the resource is located or downstream from these areas. It may not result in the extraction of salt or salt water from the coal beds. It may not cause contamination of surface or ground water, and may therefore not affect either the quality or the quantity of currently used water resources. It may result in the extraction of a greater fraction of the methane from the same resources, and thus produce a much greater amount of energy from them, when compared to currently used methods. It may also require a much smaller amount of outside energy for the development of these resources. It may provide long-term, steady, and year-round employment of a highly technical nature. It may add to the income of the region where it is applied without adversely affecting the existing economy or way of life. It may operate in harmony with the natural landscape and with the physical characteristics of the resource and the area in which it is found, and may cause no harm to that area. In short, this invention offers an alternative method of extracting coalbed methane which may be superior to that currently employed.

Coalbed methane is a form of natural gas which is found at various sites in the western United States and elsewhere. It differs from conventional natural gas, which is confined to the interstices of porous rock formations which are overlain by an impermeable geologic stratum which keeps the gas from escaping into the atmosphere. Coalbed methane consists instead of various hydrocarbons which belong to the paraffin series of compounds, and which are dissolved in water which permeates certain coal beds found deep underground. It has been given the name coalbed methane because this gas is essentially the only one which can be readily extracted from the deposit by using the current method of drilling wells down into the coal beds from above.

This selective production results from the differing thermodynamic properties of the gaseous paraffins. Methane is only slightly soluble in water at atmospheric pressure, but its solubility increases rapidly as the pressure increases. Ethane is only marginally soluble in water at all pressures, and is therefore rare in saturated coal beds. Propane and butane are quite soluble in water at all pressures, including atmospheric. When a well is drilled into a water- and gas-saturated coal bed, the pressure of that water is almost instantaneously reduced to values near atmospheric. This drastically reduces the solubility of the methane in the water and causes it to bubble out rapidly, forming a lightweight froth which is forced upward through the well by the much higher pressure found in the coal bed surrounding the well. This pressure is so high that such wells are often artesian in nature, and tend to spew both gas and water into the air unless the well is quickly capped.

When this froth reaches the surface and is captured in a suitable container, it can easily be separated by gravity into methane and water. The methane is then pumped into pipelines for delivery to the market. But this superfluity of methane discharge lasts only a short time. The tiny portion of the coal bed punctured by each well quickly becomes exhausted of its limited supply of both water and methane, and the diffusion of both fluids through the coal from as yet untapped regions nearby proceeds very slowly. To keep the well producing, therefore, a pump must then be installed to force more methane-containing water to the surface. In order to speed up the supply, another process called hydraulic fracturing is often added. Water is pumped down the well into the coal bed at high pressures in order to break the coal into smaller fragments and thus expand the network of microscopic cracks through which diffusion normally takes place. Since the latter two named processes—pumping water upward and then pumping other water downward—counteract each other, each process must be conducted for a limited time and then reversed for a comparable period. In between, long periods of inaction must be endured.

This method of extraction inevitably brings with it certain social, environmental, and economic side effects which at times can be quite severe. Since the wells must often penetrate thousands of feet of overburden before encountering the coal beds, very tall drilling rigs and very long sections of both drilling pipe and casing must be used in order to minimize the frequency of adding new sections. Thus the trucks transporting these materials to the drilling site must also be of great length. In order to accommodate this length, the roads leading to all sites must be made wide enough to allow these trucks to negotiate curves. Both these roads and the well sites themselves must be cleared of vegetation and flattened over extremely large expanses in order that the trucks and rigs can be maneuvered easily. This means that an open space covering dozens of acres must be cleared for each site surrounding a drill hole which may be only a foot or so in diameter. In places where the terrain is not flat, or where the soil is fragile, this disturbed land can be restored to its original condition only with great difficulty and at great expense.

In areas where coalbed methane wells have been drilled near homes supplied by water wells tapping into aquifers which lie above the coal beds, severe contamination of the water from these wells has occurred subsequent to the drilling of the methane wells. This contamination consists of hydrocarbons dissolved in the water, and has led to incidents such as water taps whose output can be ignited when opened, as well as gas-filled well houses which have exploded due to a spark of some kind. This situation, which definitely did not exist prior to the gas well drilling, was undoubtedly caused by propane, butane, and/or residual methane forced upward to the higher aquifers around the outside of the unsealed methane well casings.

The drilling of large and deep wells for methane, as well as other related processes, leads to loud persistent noise which often continues day and night. And the movement of energy company vehicles along the almost always unpaved roads serving the wells generates large and persistent dust clouds which cannot be confined to the well sites. Both of these aspects of the process cause severe annoyance to other residents of the vicinity. Moreover, the production of gas from each well is of limited duration, since the portion of the coal bed near it quickly becomes depressurized and dewatered. Thus the long-term exploitation of such a deposit requires repeated moving of the drilling and pumping equipment from one site to another. All of this disturbance is expected to continue for many years and to affect vast tracts of land, thus making it very difficult, if not impossible, for others to dwell in the same areas or to use the same land for other purposes without undergoing major unfavorable changes in their life styles.

Each well must be served by its own pipeline, and each of these must be connected to a network of larger pipelines leading to market areas. For safety purposes, all of these lines must be buried underground. In order to minimize the total length of the pipelines, they must be laid in lines as straight as possible, thus crossing numerous parcels of both public lands, which dominate the regions where coalbed methane is found, as well as many private parcels which have been owned and occupied by others for many years. Power of eminent domain has been granted to the energy companies to allow them to locate such lines where they wish, with other users having little voice in their location. The disruption due to this activity will also migrate from place to place as other portions of the coal beds are sequentially developed.

Many of the adverse effects of this process are site-specific. To cite one major example, one of the largest of all coalbed methane deposits lies in the Piceance Basin field located mainly in northwest Colorado and extending into adjacent portions of Wyoming and Utah. The water saturating the coal bed was derived primarily from humid mountains located on the periphery of this bowl and reaching as high as 14,000 feet in elevation, plus a number of large and high mesas capping the beds themselves. The center portion of the coal bed, which lies at lower underground elevations and is the richest in dissolved methane because of the higher water pressures found there, descends well below sea level. Thus the wells tapping the deposit here must be extremely deep, perhaps 15,000 feet or more in some places.

The geological conditions of the Piceance Basin field are quite unique. Except for the high peaks surrounding the bowl and some of the high mesas which cap the coal beds, the geologic formations under which the methane is found are notoriously unstable. Wherever the erosion-resistant capping mesas have been eroded away, the land surface is primarily made up of landslide deposits. This landslide process is still very active, as exemplified by the one-mile-square block which slid downhill only a few years ago, burying about a mile of Colorado State Highway 133 so deep that the new road had to be build on top of the slide. The landscape here and at other spots in the basin is thus very irregular in its topography, with very little level land being found anywhere. Because of these two factors—irregular topography and low geologic stability—erosion due to future water runoff over land disturbed by the current coalbed methane process and inadequately restored is likely not only to be very severe, but also to persist for centuries. The practice of hydraulic fracturing of the coal beds adds to the likelihood that unwanted land movement will take place. It replaces coal deposits of moderate structural integrity with thick fluids consisting of coal fragments suspended in water. This material cannot support the overlying strata nearly as well as the undisturbed coal can. Therefore the probability of deep ground movement is greatly enhanced. This factor, combined with the low intrinsic geologic stability of the strata overlying the coal beds, can only result in increased rates of both landslide activity and subsequent surface erosion.

The land surrounding the methane field is primarily agricultural, with the local economy being highly dependent on the irrigation of orchards and other food crops, as well as hayfields and pasture land. Improperly checked erosion will inevitably cause wholesale disruption to this major part of the local economy and its accompanying life style through the lowering of stream beds and the siltation of both irrigation ditches and irrigated lands. Coalbed methane development will also adversely affect tourism, which forms another major portion of the present economy. Recreational activities, both for the local population and for visitors from all over the country, would also be sharply curtailed. A way of life which has existed here for well over a century could therefore be threatened by improper land restoration. This threat is further compounded by past and present experience regarding the State laws governing the restoration of land damaged by mineral extraction activities in the region. Enforcement of such laws has typically been either inadequate or nonexistent. As a result, considerable harm to established institutions by such temporary development has occurred frequently in the past.

Another factor specific to the Piceance Basin coalbed methane deposit may be of even greater concern, since it could adversely affect regions and populations up to a thousand miles away. In addition to methane, the water saturating such coal beds also contains large amounts of salt. In the Piceance Basin deposit, the salt content is extraordinarily high. Measurements taken from test wells in the area show salt contents ranging from 7 to 15%, or two to four times as high as that of sea water. And the Piceance Field is so vast that the total amount of salt it contains is greater than that found in Great Salt Lake. Since this salt inevitably comes out of the well with the water, suitable means must be provided for its subsequent disposal. One means which cannot be utilized, but unfortunately is being used at the present time, is simply to let gravity carry it away down the Colorado River. This river supplies all or part of the water supply, for both drinking and irrigation purposes, of a region populated by some 40 million people and extending from Colorado to Utah, Arizona, Nevada, southern California, and the Mexican states of Sonora and Baja Calif. It has been know for some time that the major contaminant in the river's water is sodium. In the lower reaches of the river, the salt content is already so high at times that the water is unusable either for domestic or irrigation purposes. Additional sodium from inadequately controlled coalbed methane development could more than double this amount, thus causing a disaster which would dwarf the actions of the ancient Romans, who poured seawater on the fields of Carthage in order to permanently destroy the land's usefulness.

Proponents of developing the Piceance Basin coalbed methane have proposed three methods of disposing of this water. One group suggested the construction of evaporating ponds held back by earthen dams located at various sites in the lower valleys of the region. They justified this proposition on the fact that the average annual evaporation rate at these semi-arid sites exceeds the average annual precipitation. But in some years, such as 1983, precipitation here was more than double the evaporation rate. If such a year should be repeated—which is an eventual certainty—all of these ponds would overflow and the salt would proceed downstream. The fertility of all lands irrigated with or flooded by this water could be destroyed as permanently as were those of Carthage. And perhaps even before this eventuality occurred, the dams would erode away due to inadequate maintenance and the same thing could happen more gradually. It doesn't matter whether the land is subjected to such salinization a bit at a time or all at once; the effect would still be the same as it was in ancient Carthage.

The second plan is to re-inject the saline water down through another series of wells to some underground strata lying below the level of the coal beds and made up of porous rock which is now free of water. But the natural tendency of water to flow downhill, even below ground, makes it extremely unlikely that any strata possessing these particular characteristics really exist. Thus it is highly probable that this method would be even more futile than the first.

A third process also results in the extraction from the coalbeds of vast quantities of highly saline water which, if not disposed of properly, will inevitably and severely contaminate all downstream riverine water resources from the coalbed methane beds all the way to the sea. The proponents of this practice have offered promises of "treatment" of this water. Since this type of water pollution is a chemical phenomenon, any treatment of it may necessarily be of a chemical nature. The primary chemical pollutant found in this water is sodium, which can come from sodium chloride or other sodium salts. Unfortunately, this element cannot be removed from water by chemical means. The reason for this is that sodium has a greater chemical affinity for water than any other elements (with the possible exception of the similar but much rarer lithium). This is why sodium is used in water softeners. When added to hard water, it displaces the calcium and magnesium ions which are responsible for the hardness of water, causing these elements to be precipitated out of the solution in solid form. But this process cannot be used to remove sodium. This is why all desalinization plants must remove the water from the sodium instead of vice versa, employing distillation (evaporation) techniques. This is an extremely energy-consuming process, and it is doubtful that the coalbed methane water even contains sufficient methane to provide enough energy to accomplish this.

The quantity of this salt contamination from existing and proposed coalbed methane wells can be shown to be more than sufficient to completely destroy the usefulness of all of the domestic and irrigation water resources presently diverted from the Colorado, Missouri, and Rio Grande Rivers downstream from the coalbeds. These water resources now serve a population of more than 50 million people from Montana to Southern California and across all of northern Mexico. And even if we had enough energy from another source to provide this water purification, the problem of disposal of the salt which would remain behind would not be solved. There are only two known places where these billions of tons of salt could safely be disposed of. One of these is beyond the continental shelf of either the Atlantic or Pacific Ocean. Securely leakproof pipelines thousands of miles long would have to be built to accomplish this. The other safe site is a bit closer to the coalbed methane fields: the great salt flats of western Utah. This could conceivably be transported by rail, but this process as well might require more energy than is available within the coalbed methane fields.

SUMMARY

Accordingly, an improved method and system for recovering coalbed methane have been developed. The method involves tunneling along a seam of coal to a point below a water table and at a depth below the water table sufficient for dissolved methane to be present in the water; separating a portion of the water containing dissolved methane while below the water table; reducing pressure on the separated portion for extracting dissolved methane; removing the extracted methane; and discharging the separated portion of water after extracting dissolved methane. The system for recovering coalbed methane comprises: a boring machine adapted for tunneling along a seam of coal to a point below a water table and to a depth below the water table sufficient for dissolved methane to be present in the water; a separator adapted for separating a portion of the water containing dissolved methane while below the water table and extracting dissolved methane from the separated portion; a first conduit adapted for removing the extracted methane; and a second conduit adapted for discharging the separated portion of water after the extraction of dissolved methane.

BRIEF DESCRIPTION OF THE DRAWINGS

FIG. 1 shows a schematic configuration of a typical boring machine. A=body of machine; B=pneumatic tires; C=cutting blades; D=rail-supported wheels; E=cog railway; F=bucket loader; G=hopper; H=helical coal conveyor; I=coal conveyor belt; J=rail support leg; K=foot pad FIG. 2 shows a rear view of the typical boring machine of FIG. 1, plus related equipment. A=body of machine; B=pneumatic tires; C=cutting blades; D=rail-supported wheels; E=cog railway; F=bucket loader; G=hopper; H=helical coal conveyor; I=coal conveyor belt; J=rail support leg; K=foot pad FIG. 3 shows a two-piston methane separation device. A=piston; $B^1$=cylinder; $C^1$=water intake valve; $D^1$=methane exhaust valve; $E^1$, $F^1$=water level sensors; $G^1$=water exhaust valve FIG. 4 shows a typical tunnel layout. $A^{11}$=main entrance tunnel; $B^{11}$=lateral tunnel; $C^{11}$=turntable; $D^{11}$=auxiliary tunnel FIG. 5 shows a typical tunnel junction layout. $A^{111}$=circular chamber at tunnel intersection; $B^{111}$=turntable; $C^{111}$=main tunnel; $D^{111}$=movable rail section; E=lateral tunnel

DESCRIPTION

The present invention describes a novel process for extracting methane gas which is dissolved in water saturating certain underground beds of coal. Since the solubility of methane in water increases with pressure from values near zero at normal atmospheric pressure, this gas can exist is dissolved form only in deep water subject to high pressures due to the gravitational force applied by the water overlying it. In addition, it can exist only where the coal bed possesses the unique combination of natural chemical and biological conditions which allow methane to be produced anaerobically by microscopic organisms fueled by energy sources which require no oxygen. Within the United States, coalbed methane is found in commercial quantities in selected portions of the Rocky Mountain West and a few other locations. The total extent of these deposits and of the amount of methane they contain, however, is large enough for coalbed methane to make up a sizable fraction of the nation's remaining undeveloped natural gas reserves.

The present invention offers an alternative to the current technique of extracting coalbed methane, which employs conventional wells drilled downward from the land surface lying overhead. The present invention also offers an alternative which may be free from all of the wholesale damage to other land and water resources, as well as to the environment, the economy, and the traditional way of life of the local community, all of which inevitably result from the extraction techniques currently employed.

Major characteristics of particular embodiments of the present invention are as follows:

Instead of relying on wells drilled downward from the surface above, access to the coal beds may be provided via near-horizontal tunnels bored through the coal itself. The entrances to these tunnels may be located primarily on the periphery of the deposit at or near natural outcrops of the coal bed. It is likely that at least some of these access points will be located at or within existing coal mines, including some which have had to be abandoned either because the water table was encountered, or because of the detected presence of (in this case) unwanted methane gas within the mine. The surface points where this access begins will normally lie above the water table of the coal beds. Therefore they will normally be free of water and allow conventional mining and tunneling practices to be followed for some distance from the entrances.

From the point where it becomes infeasible to use conventional mining practices to bore the tunnels further due either to methane (or other hydrocarbons) in the air or to the first encounter with the water table—the tunnels will proceed within the coal beds themselves, following the same downward angle displayed by the beds. Since the water surface so encountered is typically open to the air, it exists essentially at atmospheric pressure, and therefore contains little or no dissolved methane. Safety precautions should be taken as this point is approached, however, due to the possible presence of propane and/or butane, both of which are somewhat soluble in water, even at atmospheric pressure. Such a mixture of hydrocarbon gases and oxygen could be flammable or even explosive, as well as toxic. In order to assure the safety of the tunnel workers, tests should be made to detect the presence of these gases as the tunneling progresses. The open-air portions of the tunnels may also require the use of concrete linings or other protection in order to prevent collapse of the tunnel roofs and to prevent too much ground or surface water from entering from outside. Another precaution which should be taken results from the fact that the water, when first encountered, will probably already contain significant quantities of salts in solution. The combination of this material with oxygen either in the air or dissolved in the water can be highly corrosive, and the tunnel materials used here may have to be more corrosion resistant than those which can be employed further along, where the oxygen content of the water will gradually be reduced.

Once the water table of the coal beds has been penetrated, far less bracing of the tunnel should be required. This is because the density of the bituminous coal in which the methane is found is normally only about 20 to 30 percent higher than that of water itself. This means that the buoyancy of the water will reduce the tendency for coal to fall from the tunnel ceiling by about 80%. Besides, the boring of a circular tunnel leaves the ceiling with the form which has been know for millennia to be the most stable of all overhead geometric shapes—the arch. Deeper within the heart of the coal beds, where the salt content is higher due to gravitational separation of highly saline (and therefore denser) water from less saline fractions, the high density may actually cause loose coal to float. Thus a lightweight support, such as an arching metal mesh placed against the tunnel ceiling, may suffice to prevent failing coal. The material used for this mesh (as well as for all other equipment which is exposed to the saline water) should preferably be made of materials which can withstand the corrosive effect of the water. It is not expected that this will be a major problem, however. Excavation of long-immersed shipwrecks deep under the salt water of the ocean has shown that corrosion proceeds very slowly in such depths, undoubtedly due to the very low oxygen content of the water found in such places. However, advance testing of all proposed materials should be conducted.

Beyond a point somewhere either before or at the submergence of the tunnel into the water, all further tunneling, coal removal, and methane extraction will typically be done by automated equipment which is remotely controlled. No workers should be sent beyond this point except for emergency purposes, and these forays may be carried out in self-contained vehicles similar to the deep sea submersibles currently used for undersea exploration, but simpler. And before such trips are even contemplated, attempts should be made to do the work using unmanned, robotic submersibles instead. Opportunities for proper design of this equipment are offered by valuable lessons learned from recent exploration of both outer space and deep ocean depths.

Several major pieces of mobile equipment may be needed, depending upon the circumstances and the embodiment involved, in order for a process to function efficiently. Among these are (1) rotary boring machines similar to those now used for applications such as highway or railroad tunnels; (2) a conveyor belt to remove the coal excavated during the boring process from the tunnel; (3) a rail system to provide both support and traction for all of the moving equipment items; (4) devices designed to separate the methane from the water in which it is dissolved; (5) a second type of excavating machine needed to form tunnel junctions; and (6) a number of smaller boring machines of a third kind needed to expand the tunnel system and thus accelerate the extraction process.

The rotary boring machine (A in FIG. 1) will be the primary tunneling tool. Since it will normally be the first item to enter any newly excavated extension of a tunnel, this machine should preferably be equipped with two separate means of support: wheels which allow it to ride on the rails which link the current site of excavation with the outside world, and which permit the movement of the various other types of vehicles as well as the boring machine itself whenever it is assigned to portions of the coal bed where no tunnel yet exists; and another set of wheels which support it at the point of excavation, to which the rail system does not yet extend. This latter set of wheels could be equipped with large pneumatic tires (B) which ride directly on the surface of the unexcavated coal lying at the bottom of the forward end of the tunnel. Such tires, made of chemically resistant materials, should preferably be large enough to assure that the weight of the boring machine is sufficiently well distributed over the fragile coal bed that it causes no damage to the underlying coal. Since the depth of the machine beneath the water table determines the pressure outside the tires, the gas pressure within them should be adjustable in order for them to maintain their proper shape at all points in the tunnel. Since the presence of any oxygen within the tunnels could be a hazard, these tires may be filled with chemically inert gases such as nitrogen (or even methane) instead of air.

Tunnel boring machines may have to be moved from one site to another or to be removed from the water in order to replace cutting blades or to effect repairs. Therefore, in one embodiment, they will be designed so that the cutting blades (C) can be retracted or folded in order to allow the machine to clear the rails and conveyor belts installed in the bottom of the tunnel when moving backward. The pneumatic tires will also have to be raised in order to clear these same features.

Since the boring machines may need to move uphill along the rails when exiting from the tunnel or moving to a different tunneling site, and since the water may contain certain dissolved or suspended materials which might make the rails slippery, mere friction between conventional wheels and rails may prove to be insufficient to provide traction. Therefore, in order to maximize control over both the linear location of the boring machine along the tunnel and its motion along the rails, the rail-supported wheels (D) may, in one embodiment, be cogwheels designed to run on a conventional cog railway (E).

A cog railway will have other advantages as well as providing maximum traction. The cogs can be used to position this and other kinds of mobile equipment very precisely. If the cog railway sections are manufactured in precisely uniform lengths, the number of these sections between any two sites along a track can be used to map this underground, underwater railway network with great accuracy. Moreover, the fact that vehicles running on this railway will normally always be moving at slow speeds makes the inherent speed limitations of cog railways unimportant.

The actual process of tunneling through a coal bed will be much easier than tunneling through most other geologic formations. Coal is much less dense and structurally weaker than typical rock strata; thus the cutting blades will be able to cut through the material at a much higher rate. Moreover, wear on the cutting blades will occur at a lower rate. But the ease of cutting is tempered somewhat by the fact that this material (like that encountered by other rotary tunneling machines) must be moved out of the way in order to allow further progress. To begin with, this task should acknowledge that the bulk volume of the fractured coal will be greater than it was while still in the solid bed. Thus a method should be developed to remove this material from the immediate vicinity of the cutting blades at a volume rate faster than that at which the cutting blades can dig it out of the solid coal bed.

In order to accomplish this task, other mechanisms which work together may be added to the boring machine. As soon as each layer of coal is cut off of the face of the tunnel's end, it should be transported away from the immediate site so that the next layer can be removed. This process can be aided by spacing the individual cutting blades around the axis of the machine so that the separated coal can pass between the blades. The process can also be facilitated by designing the front profile of the cutting blade assembly (and therefore that of the excavated coal face as well) so that it forms a rounded or slightly conical surface concave to the coal bed. Thus the coal falling from the bed will be given a head start away from the face. The first of a train of material transport devices (F), such as the conventional bucket loader shown in the embodiment of FIG. 1, will continuously scoop the fractured coal off of the bottom of the tunnel and carry it upward, where it will be dumped into a hopper (G). This will direct the coal to a circular conveyor (H) which will also be attached directly to the boring machine. The coal will be fed into a horizontal tube, also attached to the boring machine at a level well above the tunnel floor. This tube will contain a helical screw which rotates at such a speed that the rate at which the coal is forced back through the tube is greater than the cutting rate of the boring machine. This tube, as well as the spiral screw housed in it, extends back beneath the boring machine far enough to allow the fractured coal to drop from its exit end down onto a moving conveyor belt (I) which is located at the bottom of the tunnel. It will probably be located along the center of the tunnel in order to provide sufficient clearance for all of the other items. All of these items are also shown in FIG. 2, which is a view from behind the boring machine. This view shows the vertical and lateral spacing of the boring machine and all of its auxiliary components.

In order for this procedure to proceed smoothly, the excavation of the coal by the boring machine should be followed very closely by the construction, in order, of both the cog railroad and the conveyor belt. Both of these procedures, however, may be pursued by the sequential attachment of pre-fabricated segments. This allows their construction to proceed at a pace faster than that of the excavation of coal.

In one embodiment, identical fixed-length segments of the cog rails can be laid end-to-end by an automated vehicle which rides on those lengths of track which have already been set in place. Each new segment of rail will be equipped with mating devices at each end, one of which matches the previously laid rail, while the other provides a matching connection for the next segment. As it moves continuously ahead, this vehicle can carry the next rail segment cantilever-fashion ahead of it. It will also pause to form a positive connection between each consecutive pair of rail segments. Because of the slow speed of all vehicles which will subsequently run on these tracks, joint smoothing welds will not be necessary. Other means can be used instead, including the insertion of either pins or bolts holding each consecutive pair of rails together. With this procedure, the railway can be kept right behind the boring machine, and will in fact extend beneath the trailing end of the tube extending back from the boring machine and containing the helical coal conveyor.

In this embodiment, almost immediately after a new segment of rail has been installed directly behind the advancing boring machine, a new segment of conveyor belt will also be installed, below the rails and between the support members for the rails. FIG. 2 shows a rear view of one possible arrangement. The rails (E) are supported on legs (J) which span the conveyor belt (I). These legs have foot pads (K) which offer a large area in contact with the coal bed near the cylindrical bottom of the tunnel, in order to distribute !the weight of the load over as wide an area as possible and thus minimize damage to the tunnel floor. These supports will be spaced out evenly along the length of the tunnel, with at least one pair attached to each segment of railway. Both the rail segments and the conveyor belt units wilt be pre-fabricated, and will be installed by the same automated machines which transport them to the site.

The conveyor belt segments will be installed in such a way that the rear end of each one will be placed directly above the forward end of the one placed immediately before. This allows coal falling off the rear end of each segment to land near the forward end of the next in line toward the tunnel entrance. This arrangements allows continuous transport of the coal all the way from the current site of the boring machine out to the tunnel entrance. The conveyor belt segments will be attached to the rail supports in order to hold them in position. It should be noted that the placement of the conveyor belt segments does not have to be as precise as that of the rail segments, as long as each one overlaps the next by a proper amount.

The conveyor belt segments near the tunnel entrance which rise above the water table may be manufactured from a mesh or other porous material. This will allow the water accompanying the coal to drain out. It will then automatically flow downward back into the tunnel from which it originated. By the time the dewatered coal reaches the tunnel entrance, it should be quite dry, although some additional drying may be necessary before it is used. It can then be burned in a small coal-fired power plant locate near the tunnel entrance, to be used (at least in part) to power the electrical equipment required for this methane extraction process. Alternatively, it can be loaded onto trains or trucks to be transported for use elsewhere.

An alternative and potentially more practical method of installing the interacting rail and conveyor belt segments is to combine one of each together as a single unit. These will be manufactured outside the tunnel and then installed together. Since the conveyor belt segments have to be longer than the rail segments in order to overlap, these combined units will be somewhat longer than separate units, but they will still occupy the same amount of space when installed along the tunnel.

Since a single combined rail and conveyor belt installation vehicle can carry only a few track-and-belt segments, it may be accompanied by a trailer or separate vehicle designed to carry larger numbers of such units. This will require one more installation function: the transfer of such units from the transport vehicle to the installation one.

Another item to be installed in the tunnel is a methane separation device designed to extract the methane from the water. This may, in one embodiment, be mounted on an independent vehicle which also moves along the cog railway. It can utilize a number of different procedures for removing the methane from the water. Perhaps the simplest and most effective will be the simple double-piston device shown in FIG. 3. Two pistons ($A^1$) mounted in the same vertical cylinder ($B^1$) will operate in sequence with each other to produce an eight-step cyclical process of separating the methane from the water. They will be assisted in this process by three valves and two sensors.

Each cycle will begin with both pistons more or less in contact with one another at a location near the top of the cylinder. The process will then proceed as follows:

1. The water intake valve ($C^1$), which can be located either in one of the two pistons or in an adjacent part of the cylinder wall, opens. The lower piston then moves downward, drawing a fixed amount of methane-saturated water into that portion of the cylinder located between the two pistons.

2. The water intake valve $C^1$) is closed.

3. The lower piston continues to move downward. This leads to an expansion of the volume occupied by the fixed amount of water. Since water is essentially an incompressible fluid, this will cause an immediate drop in the pressure within the cylinder from the high values found in methane-containing coalbed water down to below atmospheric values. This drop in pressure causes the dissolved methane to bubble out rapidly and float to the top of the cylinder, forming a single large gas bubble there. Once all of the methane has been removed from the water, further withdrawal of the piston will do nothing more than to reduce the pressure of the methane gas to values well below atmospheric and result in further expansion.

4. The methane outlet valve ($D^1$) opens. This valve is located on the cylinder wall somewhere near the midpoint of the chamber defined by the two pistons. The lower piston then rises, pushing the methane out into the methane pipeline leading back to the tunnel entrance.

5. When the water level reaches the level of the methane outlet valve, a sensor ($E^1$) on the cylinder wall causes the lower piston to stop. The high electrical conductivity of the salt-laden water will make a number of conventional designs for such sensors acceptable.

6. The upper piston then moves downward, pushing the remainder of the methane out through the open methane outlet valve. When this piston reaches the water level, a similar sensor ($F^1$) mounted on the upper piston causes it to stop and the methane outlet valve to close.

7. The water outlet valve ($G^1$), also mounted on the upper piston, then opens; the lower piston rises once again, pushing the methane-depleted water out through this valve. From there it flows, through a hose connected to the upper piston, to a water pipe leading back toward the tunnel entrance.

8. When the lower piston contacts the upper piston once again, the water outlet valve is closed and the two pistons are moved together back to the position they occupied at the beginning of the cycle. A new cycle can then begin.

The force used to move the pistons may be provided by such devices as solenoids or rack-and-pinion mechanisms, controlled electronically. In one embodiment of the procedure, the stroke of individual piston cycles can be automatically adjusted to match the methane content of the intake water. At high methane levels, more gas can be recovered with each stroke, and the strokes will be longer. As the methane content decreases, the strokes will become shorter. When the process begins to produce so little methane that it becomes unprofitable to continue the operation, the separator will be moved to a point deeper into the tunnel where the methane has not yet been depleted.

Two or more cylinders located at essentially the same point within a given tunnel will be processing water with similar methane contents, and the stroke length and frequency of cyclical operation of both are likely to be identical. This leads to the possibility that an alternative separator can be used, in which the single large cylinder is replaced by a number of smaller ones linked together by a crankshaft or other suitable cycle timing mechanism. It is known from automobile engine design that an in-line six-cylinder auto engine is automatically balanced; that is, it generates no unbalanced forces which might cause the engine to undergo oscillatory motions and therefore disrupt its stability. Both the methane and the methane-depleted water exhaust ports from each cylinder can be linked with manifolds to simplify the operation and to smooth the flow of both fluids out of the separator. One can even go one step further and include an overhead camshaft to control all of the necessary valve openings and closings. This will result in a methane separator which bears an uncanny resemblance to an old six-cylinder auto engine. The main difference would be that the engine uses fuel to provide power for external use, while the separator requires power from outside (probably in the form of an electric motor) in order to produce fuel. The increased smoothness of operation of such a multi-cylinder separator is likely to outweigh any small amount of unrecovered gas which might result from differences in cylinder efficiency.

Ocean-going ship design has demonstrated that rubber bearings work very well in marine applications, such as for ship propeller shafts. Thus the pistons of these separation devices could be equipped with rubber O-rings instead of metal piston rings, since lubricants should not be employed in this watery and saline environment.

In order to retrieve methane from coalbed deposits, the water in which the methane is dissolved should brought to a point where the gas can be separated from the water. In the case of conventional coalbed methane wells, this point lies above ground at the wellhead, and the water gets there first because of a pressure gradient between the high-pressure water in the coal bed and the atmospheric pressure at the wellhead, and later by means of pumping the water up from the bottom of the well. The present invention, on the other hand, leaves the water below ground within the coal bed where it now lies, and thus eliminates the need for disposal of either the water or the dissolved salt it may contain. Moreover, the pressure gradient within the separation chamber is artificially applied, and is therefore under control of the operator of the system.

As one extracts methane from the water of a coal bed at any point and by any means, the methane content of the water in the immediate vicinity of this point is reduced by the amount removed. Eventually this effect reaches the point where it is no longer practical to retrieve additional methane, and the separation device must be moved on to a more virgin site. But the removal of methane from any one site induces a methane concentration gradient to build up between this point and its undepleted surroundings. This gradient in turn causes methane to migrate through the water (and the coal) back toward the depleted site. This recovery process proceeds at a rate which depends on the physical and chemical characteristics of the particular deposit, as well as on the method used to retrieve the gas. In the case of drilling, both the chemical and physical makeup of the coal in the vicinity of the original site quickly become so severely disturbed over a relatively short range that such recovery proceeds very slowly. Thus it is almost always easier to drill another well some distance away and repeat the process there.

In the case of the present invention, however, the disturbance to the surrounding area is minimal, and such recovery occurs much more rapidly. The reason for this difference can be deduced from a knowledge of the manner in which both water and methane migrate through coal. In both cases, the methane flows through the water of the coal bed because of the induced methane concentration gradient. The effectiveness of this migration is a function of three parameters: the porosity of the undisturbed coal through which the methane must move (which is the same in both cases, unless hydraulic fracturing has been used), the pressure gradient between the water in the undisturbed portion of the coal bed and the site of the retrieval apparatus (also the same in both cases after a short period of time), and the cross-sectional area of the path available for such flow to take place. In the case of current well-drilling techniques, this area is severely limited.

In the best case scenario, where the well is drilled to the bottom of the coal bed but the well casing is installed only to the coal bed's top surface, it is equal to the circumference of the well times the thickness of the bed. For one potential embodiment of the proposed tunnel system (including some vertical flow from the top and bottom of the bed), it equals the circumference of the tunnel times its length.

For a comparison of the two processes, let us assume a coal bed 50 feet thick and a well spacing of one per 160 acres (the current standard). Each well will drain only the portion of the coal bed within a quarter-mile surrounding it. A one-foot diameter well drilled into this bed will have a flow cross-section of only 157 square feet. A ten-foot tunnel bored into the same portion of the coal bed, on the other hand, will have a flow cross-section of 31.4 feet times the same half-mile share of the deposit. This equals 83,000 square feet, or more than 500 times the well's capability. Thus the capacity for recovery of the site sufficient to allow subsequent extraction of methane from the same region can be increased by this factor of 500 by the present invention.

This explains why so many surface wells are needed to tap a coalbed methane deposit of a given size. This also explains why the practitioners of this method seek to have the well spacing reduced from the current standard of one per 160 acres to one per 80, 40, 20, or even 10 acres. Moreover, some of the wells needed to reach the lowest (and therefore the richest) deposits could be as much as three miles deep. If we calculate the comparison of the two techniques on the basis of gas retrieved per unit length of drilling (or boring), the 500:1 ratio of recovery effectiveness becomes amplified to as much as 3000 to one. Thus the greater per-foot cost of boring tunnels can easily be justified, even without considering the elimination of all of the adverse social, environmental, and land-and-water destruction issues engendered by drilling.

These huge advantages of the tunnel system allow methane to be retrieved from the same sites within the tunnels on a repeated basis, and permit the systematic development of the resource to be carried out in an orderly progression over a period of many years without having to move the operations to new sites. It also permits a far greater fraction of the total methane supply to be retrieved, without resorting to such costly and potentially destructive tactics as liquid nitrogen treatment or hydraulic fracturing of the coal beds. The total amount of input energy required to acquire the energy locked in the coal beds will also amount to a far lower value by utilizing this method, when compared with that needed for a continuation of current practices.

The methane retrieval rate of the tunnel technique may be multiplied even more by boring additional tunnels laterally from the main entrance tunnel (A11 in FIG. 4). For maximum effectiveness, these laterals (B11) should be arranged in a dendritic pattern (named for its resemblance to the branches of a tree). In this way a very large area of coal bed can be served by a single entrance, even if the main branch of the tunnel is only a few miles long. In order to effect this geometry, however, it must be possible for the boring machines to leave the main tunnel and move away at an angle.

The best way to fulfill this capability may be to install a turntable at each tunnel intersection ($C^{11}$). One possible arrangement for this device is shown in detail in FIG. 5. This can be accomplished be using a different kind of coal excavation machine. Unlike the one which bores a cylindrical tunnel along a straight and nearly horizontal path, this machine will begin at a pre-selected site along the main tunnel and work outward in a circular pattern until it has excavated a round chamber (A11) with a diameter slightly greater than the length of the longest vehicle working in the tunnel system, and a height sufficient to provide clearance for the tallest such vehicle. The turntable itself ($B^{11}$) does not have to be very large, with a diameter perhaps only as great as that of the main tunnel ($^{C11)}$. This excavation process will be easier if the machine can first excavate a cylindrical cavity of this size and then install the turntable. Then it can work outward radially from this small space until the entire cavity has been finished. Because of the size of this chamber, it is likely that much stronger ceiling bracing will be required here than elsewhere.

The next step is to mount a rigid section of straight rail ($D^{111}$), long enough to reach the rail extensions leading into each connecting tunnel ($E^{111}$), atop this turntable. Any vehicle making a turn at this point may be driven onto and parked on the movable rail. The weight distribution of these vehicles along their lengths may be sufficiently well balanced that they can be supported over the pivot point without causing any significant tilting moment. An alternative technique will be for the ends of the movable rail segment to be supported by wheels running on a circular rail installed along the circumference of the chamber. When the turntable has been rotated to the proper angle, these vehicles can then proceed to their workplaces.

These turntables can also serve additional functions. One of these, similar to that of conventional railroad sidings, will be to allow two vehicles to pass each other along a single track line. Whenever two vehicles moving in opposite directions along the track system must get by each other, one of them can proceed to the nearest turntable. It can then be shunted off temporarily into one of the side tunnels until the other vehicle has passed the intersection, at which time it will proceed along its own path.

The conveyor belts carrying excavated coal from side tunnels will in one embodiment, all lie below the level of the rails. They can be brought together near, if not at, the center of the chamber. They will be designed so that all coal can be transferred at this point to the belts leading to the tunnel entrance. Also lying beneath the level of the rails will be the hose or pipe transporting gaseous methane out of the tunnel system and the hose or pipe transporting methane-depleted water away from the current sites of methane extraction.

The large size of the chambers surrounding each tunnel intersection can also allow them to serve yet another function: as discharge points for methane-depleted water. With their large lateral surface area in contact with the coalbed, combined with their ready connections with other tunnels leading off in other directions, the chambers can provide optimal sites for the dispersal of this water back into the coal bed, where it will have the maximum opportunity to collect additional methane from those still methane-rich sites lying at a distance from the tunnels. After a sufficient amount of time has passed, this homogenization process will allow methane extraction to occur once again at the same sites which have been treated before. As this process continues and the methane is extracted, the periphery of the coal bed will eventually become depleted. This will begin near the periphery of the bed, where the tunnel entrances exist, and will progress slowly inward toward the center of the bed. As the extraction rate begins to exceed the internal migration rate of the remaining methane, a more permanent situation will arise, with the methane concentration in the water varying even more along the length of the primary access tunnels.

In a further embodiment, the methane extraction rate from the tunnel system can be increased even more by the addition of auxiliary tunnels and the use of yet another type of excavation equipment. Such tunnels are also shown ($D^{11}$) in FIG. 4 as dotted lines of limited length. They may be much smaller than the tunnels through which vehicles must be transported, perhaps ranging from a few inches to a few feet in diameter. These tunnels may be drilled, using a tool similar to conventional twist drills. These drills, like those used for well drilling, will be segmented, with different sections being added as the drilling proceeds. Only the end segment need be equipped with cutting edges. The others will provide only a conveyor (again similar to the shafts of conventional twist drills) which forces the excavated coal back along the drill shaft. This coal will then be dropped onto the conveyor belts of the tunnels and removed from the system. When such a drill hole has reached its design length, the drill will be extracted and disassembled, piece by piece, and then moved on to the next drilling site. It is likely that the conduction of this entire operation can be confined to the width of a typical tunnel, with the mechanisms performing the operation being designed to complete a hole from a single stop along the track.

Navigation through the coal beds would benefit from knowledge as to the extent and the geometry—both vertical and horizontal—of the coal beds themselves. Today most of the available information about this subject has been obtained from the logs of wells which have been drilled down far enough to reach these formations. But it is well known that further drilling of such wells is a dangerous activity due the presence of highly saline water in the coal beds and the high pressure of this water. But further exploration can be achieved from the tunnels drilled from the beds' periphery without encountering any such adverse effects. Low intensity seismic equipment can be used to send sound waves into the coal and to measure the reflections of these waves back from the beds' interfaces with other rock formations. From the records attained in this way, highly accurate maps of the geometry and extent of the beds can be obtained. Plans can then be formulated for further expansion of the tunnel system.

In addition to the basic equipment described in the preceding sections, numerous other devices may be added to the various vehicles which penetrate the tunnels. To begin with, the different boring machines, rail transport and installation vehicles, conveyor belt transport and installation vehicles, and methane separation mechanisms will, in one embodiment, all have their own propulsion and power systems. These may consist of electric motors, since internal combustion engines are impractical because of the absence of oxygen beneath the water. These various vehicles may also be designed so that they can be connected to one another. This will allow any one of them to haul another out of the tunnel in case of a failure of any device's motive system.

The motors should be sealed against possible corrosive effects of the saline water. Since salt solutions are also good conductors of electricity, protection against electrical shorts should also be provided. At the same time, however, the motors should also be cooled in one embodiment by surrounding them with some heat transfer medium. one possible choice would be the use of salt water itself. Cooling systems used for naval applications should be readily adapted for this purpose.

Other equipment which may be needed by some of the motive units can include a combination of lights and closed-circuit television. This would allow technicians above ground to visually monitor the progress of the various steps of the extraction process. Another useful accessory may be one which can continuously detect and report changes in the nature and geometry of the coal bed along a certain path. Yet another would continuously record the distance, slope, and direction of progress of each new step of tunnel boring, from the tunnel entrance to the latest worksite. This automated dead reckoning system could then be used to produce highly accurate maps of the entire area covered from each tunnel entrance. These data could then be used to plan later tunnels or tunnel alterations, including those which would enter the coal bed from other sites along its periphery. In this way, the entire coal bed could be developed over the years without disturbing the surface land above it.

All of these devices may require the use of electricity. The source of this energy will be, in all probability, small power plants located at or near the entrances to the tunnels and fueled by the coal removed from the tunnels. To get this electricity to the vehicles working inside, in one embodiment, power cables may be strung within the tunnels from their entrances to each work site. Such cables, shrouded by suitable insulation and protective housings, may be installed along the tracks below the level of the rails. Suitable means of attaching the various working devices to these cables in such an electrically conducting environment such as sealed outlets, would be included. This task will be aided by the fact that the saline water itself offers a much better ground connection than any separate conductor which might be installed. Thus it may be possible to use a single conducting cable instead of the usual two or more. If this conductor were to have a circular cross-section, the task of electrically insulating the hot wire from the ground will be facilitated.

One possible solution may be to use many sections of conductor instead of a single long one. These would be preinstalled on the sections of rail and/or conveyor belts. At the outward end of each newly installed conductor section, where it must be connected to the following one, there will be a hollow rubber seal into which the new conductor segment is to be inserted. Just behind this seal will be a switch which is in the off position until shifted to the on position by the insertion of the new conductor. Thus each new conductor section will not be connected to the power supply until it has been sealed off from tire salt water. Note that if small amount of this water becomes enclosed with the conductor at the point of connection and then sealed off before the switch is opened, it will have no effect other than to slightly increase the amount of conductor at the connection.

Outlets directing power to the various working devices can be similarly designed, and will also not become completely connected until after their switches have been turned on. In these cases, where the devices will later be disconnected, the switches should be designed such that they will automatically be turned off before the water seal is broken. It is likely that at least one such connector will be installed at suitable locations on each rail segment. Thus those vehicles needing power will always be in a position where they can obtain electricity.

For the power needed to propel a vehicle from one worksite to another, batteries can be installed within that vehicle. When extremely long distances have to be covered, the vehicle may have to stop temporarily, probably at tunnel interchanges which can be used as sidings, in order that its batteries can be recharged.

Control centers located which may be at each exterior tunnel entrance, will somewhat resemble the control centers for space vehicles or the war rooms used to direct military operations. All of the data produced by the various monitors within the tunnels may be collected and processed there by skilled technicians. Electronic maps could exhibit the location of all sites of current activity taking place within the tunnel system, plus the positions of each vehicle of any kind which is currently in operation there. Many decisions as to the disposition of these vehicles could be automated, but those decisions involving new expansion of the system, repeated methane extraction activities, and other nonsystematic operations would be made by the technicians themselves.

In contrast to current methods used to extract coalbed methane, this process may require only a minimum use of land surface, all of which may be located at or near tunnel entrances. Most of these will be sited along existing roads, with many of them being located at existing or abandoned coal mines. All gas pipelines delivering the methane to market could then be constructed along these existing roads. Note that only one such pipeline would need be constructed for each tunnel entrance, whereas hundreds, or even thousands, of pipelines (one for each well) must be installed in order to serve all of the wells which must be utilized in order to extract methane from the same service area by using today's drilling techniques. And this one pipeline itself would be of limited length, since it would potentially be needed only to a point where it can connect to an existing natural gas pipeline.

No disturbance of the land surface overlying the coal beds, or of the natural or planted vegetation growing on that surface, may be necessary if the tunnel process is used, except possibly in the vicinity of a few test wells drilled in order to map the extent of the coal bed at points far from the field's periphery. Moreover, these test wells would not themselves be used for methane extraction. They could be of much smaller bore than extraction wells, and would be designed so that they could be sealed off at any level as soon as the pertinent data (well depth, coalbed thickness, water pressure, water temperature, water methane content, and a complete log of all overlying strata) had been measured, transmitted, and recorded.

All of the saline water now present in the coal beds may be left there, at levels too deep to affect any land or water resources within or beyond the coal bed area, or any aquifers lying above the coal beds. In fact, the level of the saline water may even drop somewhat because of the extraction of coal from the tunnels. This would remove this toxic water even further from possible contact with existing fresh water resources. In addition, again except for the few scattered test wells, there would be no need to transport equipment or workers across public or private land overlying the gas field, or to build any new roads to provide access.

Again in sharp contrast to current methods of coalbed methane development, this process may have few if any adverse effects on the existing social, environmental, or economic character of the regions where coalbed methane is found. Positive effects might include a modest increase in net income to these regions because of the formation of a limited number of jobs of highly technical or skilled nature. In states which have installed excise tax laws on mineral extraction and exports—and are willing to use these laws—these economic benefits might be far more than modest. Land values should not be adversely affected; nor should the local tax structures, except for the positive effect of additional tax revenues from the methane industry. The long-term nature of this process may also add stability to the local economy.

The current residents of the areas where coalbed methane is found may also rest assured that they—and not distant energy conglomerates—will be able to dictate how their lives will be managed. They will be able to make their own plans for the future, secure in the fact that no sudden changes in their lifestyles will be forced upon them, and secure that they will be able to hand something of value down to their children and their children's children. From a wider viewpoint, this process may provide a substantial source of gaseous fuel to the nation without causing any significant adverse effects.

Eventually, this resource—like all other fossil fuel deposits—will itself be depleted. But the knowledge and experience gained through this process may aid in the development of future energy resources. For example, it is known that the total energy content of the coal beds in which the coalbed methane is found is several times greater than that of the methane itself. If this resource is to be extracted as well, many of the same underwater tunneling and resource extraction techniques developed for methane may be employed not only in these same coalbeds, but in others as well, including those where no water is present. This might allow our descendants to look back on the early 21st century, when men were actually sent underground to wrest coal from the toxic and hazardous bowels of the earth, and relegate this period to part of the dark ages. The continuation and expansion of this process may even extend further into the future, when all of man's energy will inevitably have to be derived through those truly renewable processes direct solar and wind. By this time, he may have recognized that the best and highest use of the remaining coal, like the vanished petroleum and natural gas, is and always was really as a source of organic chemicals.

It should be understood that the specific embodiments of the present invention described above may be modified or revised without departing from the spirit of the present invention. For example, the separator for extracting methane from the water may be selected to operate on a continuous basis, such as through use of a centrifuge. Accordingly, the present invention should not be viewed as limited by those embodiments but rather, its cope should be viewed as set forth in the following claims.

What is claimed is:

1. A method for recovering coalbed methane comprising:

tunneling along a seam of coal to a point below a water table and at a depth below the water table sufficient for dissolved methane to be present in the water;

separating a portion of the water containing dissolved methane while below the water table;

reducing pressure on the separated portion for extracting dissolved methane;

removing the extracted methane; and discharging the separated portion of water after extracting dissolved methane.

2. A method according to claim 1 wherein the tunneling begins at a point above the water table.

3. A method according to claim 1 wherein the tunneling begins in an abandoned coal mine.

4. A method according to claim 1 wherein the tunneling begins in an existing coal mine.

5. A method according to claim 1 wherein the tunneling begins at a natural outcrop of a coal bed.

6. A method according to claim 1 also comprising providing at least one branch tunnel from a primary tunnel in the seam of coal.

7. A method according to claim 1 wherein the discharging comprises conveying the separated portion of water after extracting dissolved methane to a point where any dissolved methane remaining in the separated portion is equal in concentration or lower than that of any surrounding water for discharge.

8. A method according to claim 1 wherein the discharging comprises conveying the separated portion of water after extracting dissolved methane to a point just above the water table for discharge.

9. A system for recovering coalbed methane comprising:

a boring machine adapted for tunneling along a seam of coal to a point below a water table and to a depth below the water table sufficient for dissolved methane to be present in the water;

a separator adapted for separating a portion of the water containing dissolved methane while below the water table and extracting dissolved methane from the separated portion;

a first conduit adapted for removing the extracted methane; and a second conduit adapted for discharging the separated portion of water after the extraction of dissolved methane.

10. A system according to claim 9 wherein the boring machine is rotary.

11. A system according to claim 9 also comprising a conveyor belt to remove coal from the tunnel formed by the boring machine.

12. A system according to claim 9 wherein the boring machine is automated and remote controlled.

13. A system according to claim 9 wherein the boring machine is adapted for traveling on rails and also comprising rails that extend along at least a portion of the tunnel formed by the boring machine.

14. A system according to claim 13 also comprising an automated rail-laying machine for adding sections to the rails as they extend into the coal bed.

15. A system according to claim 13 wherein the rails are cog rails.

16. A system according to claim 13 wherein the rails are comprised of rail sections and also comprising conveyor belt sections attached to the rail sections for removing coal.

17. A system according to claim 9 also comprising an electrical line extending along the tunnel for providing power to any system components requiring electric power.

18. A system according to claim 17 wherein the rails are comprised of rail sections and the electrical line is comprised of segments attached to the rail sections and adapted for interconnection as the rail sections are joined together.

19. A system according to claim 18 wherein each of the electrical line segments has a switch that is turned on only after two electrical line segments are attached together.

20. A system according to claim 9 wherein the boring machine is powered by electricity.

21. A system according to claim 20 wherein at least a portion of the electricity to power the boring machine is generated by burning coal extracted by the boring machine.

22. A system according to claim 9 also comprising an excavating machine adapted for forming at least one branch tunnel to the tunnel formed by the boring machine.

23. A system according to claim 22 also comprising at least one additional separator for a branch tunnel.

24. A system according to claim 9 wherein the separator comprises a cylinder, a first piston sealingly movable at a first end of the cylinder, a second piston sealingly movable at a second opposed end of the cylinder, a water intake valve, a methane outlet valve and a water outlet valve.

25. A system according to claim 24 also comprising means for controlling the timing for the opening and closing of the water intake valve, the methane outlet valve and the water outlet valve.

26. A system according to claim 25 wherein the means for controlling comprises a water level sensor on an internal wall of the cylinder and a second sensor on an internal face of the first piston.

27. A system according to claim 9 wherein the separator comprises a centrifuge.

28. A system according to claim 9 wherein the second conduit conveys the separated portion of water after extraction of dissolved methane to a point where any dissolved methane remaining in the separated portion is equal in concentration or lower than that of any surrounding water for discharge.

29. A system according to claim 9 wherein the second conduit conveys the separated portion of water after extraction of dissolved methane to a point just above the water table for discharge.

30. A system for recovering coalbed methane comprising:

means for tunneling along a seam of coal to a point below a water table and to a depth below the water table sufficient for dissolved methane to be present in the water;

means for separating a portion of the water containing dissolved methane while below the water table and extracting dissolved methane from the separated portion;

means for removing the extracted methane; and means for discharging the separated portion of water after the extraction of dissolved methane.

* * * * *